United States Patent [19]

Beisser

[11] Patent Number: 4,638,554

[45] Date of Patent: Jan. 27, 1987

[54] METHOD OF CONSTRUCTING TRANSFORMERS USING A TRANSFORMER-COIL WINDING WHEEL

[75] Inventor: Jean-Claude Beisser, La Chaux de Fonds, France

[73] Assignee: Societe Nouvelle Transfix, Cahors, France

[21] Appl. No.: 637,330

[22] Filed: Aug. 3, 1984

Related U.S. Application Data

[62] Division of Ser. No. 466,660, Feb. 15, 1983, Pat. No. 4,542,362.

[30] Foreign Application Priority Data

Feb. 19, 1982 [FR] France ..... 82 02753
Feb. 19, 1982 [FR] France ..... 82 02754

[51] Int. Cl.[4] ..... H01F 7/06

[52] U.S. Cl. ..... 29/605; 29/606; 336/198; 336/213; 336/92

[58] Field of Search ..... 29/602, 605, 606; 336/198, 208, 213; 242/6, 4 R, 4 A, 7.03

[56] References Cited

U.S. PATENT DOCUMENTS 2,305,999 12/1942 Steinmayer et al. ..... 242/4 R

*Primary Examiner*—Howard N. Goldberg
*Assistant Examiner*—P. W. Echols
*Attorney, Agent, or Firm*—Young & Thompson

[57] ABSTRACT

Each end of an insulating tube which surrounds a transformer core projects beyond the electric circuits carried by the tube and is associated with an annular spacer member having two radially displaced bearing surfaces applied respectively against the core and the tube. An axial slit formed in the insulating tube is opened-out in order to insert a transformer core within the tube and then re-closed. A driving wheel is removably coupled to the tube in order to drive it in rotation during the winding operation.

2 Claims, 19 Drawing Figures

FIG_13
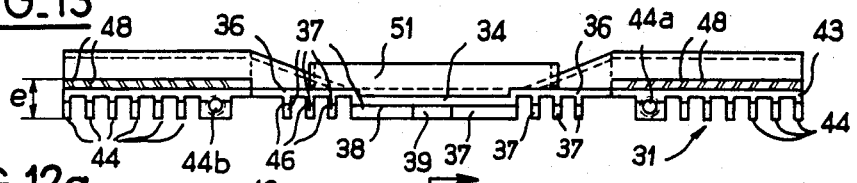
FIG_12a
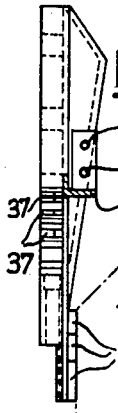
FIG_11a
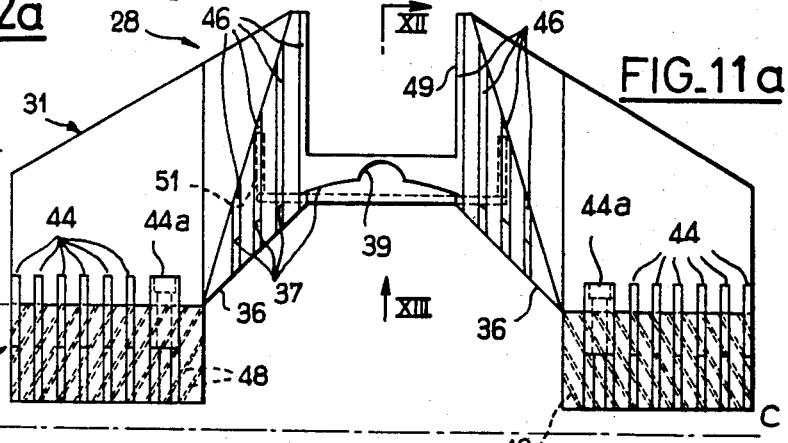
FIG_11b
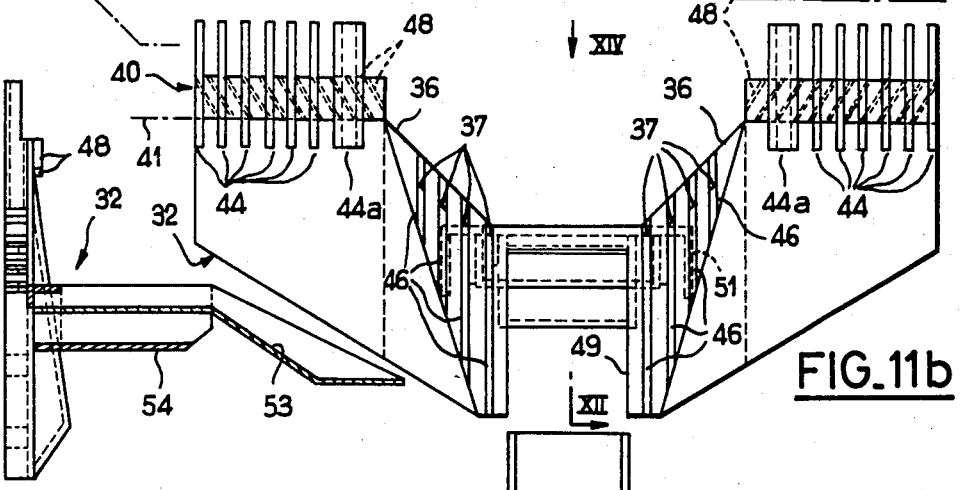
FIG_12b
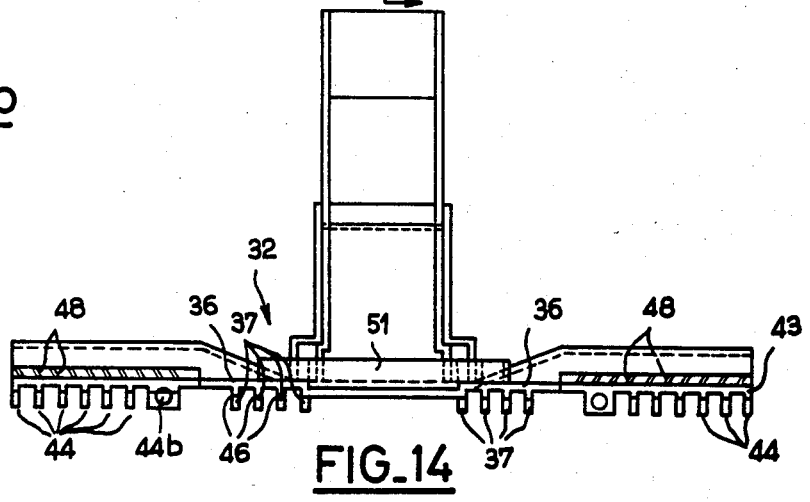
FIG_14

METHOD OF CONSTRUCTING TRANSFORMERS USING A TRANSFORMER-COIL WINDING WHEEL

This application is a division of application Ser. No. 466,660, filed Feb. 15, 1983, and now U.S. Pat. No. 4,542,362.

The present invention relates to a method for constructing a monophase or polyphase electric transformer, more particularly of the type in which the magnetic circuit defines at least one rectangular window.

The invention further relates to transformers of this type as well as to a wheel for winding a transformer in accordance with the method aforesaid.

In the transformers which are contemplated by the invention, the low-voltage and high-voltage electric circuits are wound on one or a number of insulating tubes and each tube in turn surrounds a magnetic core constituted by one of the branches of the magnetic circuit. Depending on the design, each circuit may have its core and its insulating tube or else there may on the contrary be only one core for each phase.

In the case of a magnetic circuit which is formed, for example, from at least one strip of rolled sheet-iron and which does not make it possible to fit the tube around the core, the insulating tube can consist of one or a number of layers of paper or paperboard rolled around the magnetic core as described in U.S. Pat. No. 2,968,445.

In other known methods for constructing the magnetic circuit such as, for example, the method of stacked sheets or laminations, it is possible at one stage of construction to fit the insulating tube over the magnetic core, the insulating tube being provided with its electric circuits.

In both cases, the electric circuits are maintained both radially and axially with respect to their core by means of wood spacer blocks which form gaps of sufficient width between electric and magnetic circuits to prevent short-circuits. A certain number of these spacer blocks are interposed between the insulating tube and the magnetic core. Other blocks are interposed between the annular extremities of the electric circuits and the magnetic yoke.

This spacing device is subject to many disadvantages. It has to be placed in position by hand with large tolerances. For safety reasons, the gaps between the electric and magnetic components are of substantial width. This results in a heavy and cumbersome unit which is costly and has low performance characteristics.

In order to construct the electric circuit of a transformer having a magnetic circuit made of rolled sheet-iron, U.S. Pat. No. 2,968,445 teaches a method whereby a thin toothed wheel is placed in position around the core and carries a cylindrical end-piece which surrounds the core. The unit consisting of a toothed wheel and end-piece is assembled together from two halves along an axial joint plane. The toothed wheel being placed at one end of the core, several layers of insulating paper are rolled around the end-piece in order to form the insulating tube and the electric circuits are then wound on the insulating tube. The two halves of the toothed wheel are then disassembled and the wheel is removed by extracting the insulating tube from the half-end-pieces in the axial direction.

The disadvantage of this method lies in the fact that, in spite of all the precautions which may be taken, the paper or paperboard tube material is delicate, has insufficient rigidity, is liable to give rise to insulation defects and therefore entails the need for safety gaps of substantial width between tube and core. Within the scope of this method, however, it is hard to see what material other than paperboard or cardboard could prove more satisfactory. Furthermore, the electric circuits cannot occupy the entire length of the core. In fact, a certain length must be reserved for the thickness of the toothed wheel plus an additional length for extracting the end-piece from the paperboard tube. Moreover, fabrication of the insulating tube is not very convenient and entails the need to take precautions in order to ensure correct and tight superposition of the paper layers.

Accordingly, one object of the invention is to provide an electric transformer in which spacing of the electric circuits is not only an easier operation but also more effective and more accurate, and in which the assembly operation as a whole is considerably simplified.

A further object of the invention is to propose a method in which the electric windings are easy to place in position on the magnetic circuit and occupy practically the entire length of the core or cores.

According to a first object of the invention, the electric transformer having a magnetic frame provided with at least one yoke and at least one core which define together at least one substantially rectangular window, at least one high-voltage electric circuit and at least one low-voltage electric circuit being placed around an insulating tube and said tube being in turn placed around the magnetic core which is associated with said tube, is distinguished by the fact that each end of the insulating tube extends axially beyond the electric circuits carried by said tube and is associated with an annular spacer member interposed between the annular extremity of the electric circuits and the magnetic yoke and that said annular spacer member is provided on that face which is directed towards the magnetic core with two radially displaced bearing surfaces, one surface being applied against the magnetic core while the other surface located nearer to the windings is applied against the insulating tube.

At each end of the windings, a single spacer member serves to ensure both centering of the windings around the core and axial positioning of these latter with respect to the core. Since all the positioning surfaces are located on the same spacer member, this latter can be manufactured with precision and can ensure accurate positioning of the windings. It is therefore possible to reduce manufacturing tolerances of the transformer and to reduce the spaces allowed between the electric circuits and the magnetic circuit. The transformer is consequently endowed with enhanced efficiency, is of lighter weight and less cumbersome. Fitting of this single spacer member at each end of the windings is performed with much greater ease and speed than was the case with the numerous insulating spacers employed in the prior art.

According to a second object of the invention, the method of construction of a transformer having a magnetic frame provided with at least one core and at least one yoke which define together at least one substantially rectangular window, at least one high-voltage electric circuit and at least one low-voltage electric circuit, in which said method consists in forming the magnetic circuit, in placing an insulating tube around the core, in detachably coupling at least one end of said tube to a removable driving wheel, and in winding the electrical turns by causing the driving wheel to displace the insulating tube in a movement of rotation, the method is distinguished by the fact that the starting element consists of an insulating tube of plastic material provided with a slit along at least one line which extends in a substantially axial direction, that said slit is opened-out in order to introduce the magnetic core within said insulating tube, that said slit is closed again and that, at this stage only, the driving wheel is placed in position around the core by coupling said wheel mechanically to the annular extremity of said insulating tube.

The result thereby achieved is a considerable simplification in the positioning of the insulating tube which not only has greater rigidity but also has higher insulating properties. It is no longer necessary to ensure that the driving wheel has an end-piece engaged within the interior of the tube. On completion of the winding operation, the driving wheel is consequently easy to remove and there is no need to provide an additional length of core for this purpose. Practically the entire length of the core is therefore available for the windings.

In an advantageous embodiment, the transformer which is constructed in accordance with the method considered in the foregoing is distinguished by the fact that the insulating tube has only one slit and is capable of opening-out elastically in order to permit the introduction of the magnetic core through the slit.

The insulating tube can thus be provided as a single part and positioning of the tube does not entail any need for a fixing operation.

According to a third object of the invention, the wheel for driving the insulating tube in rotation for winding a transformer of the type mentioned above and comprising two half-wheels to be assembled together around the core is distinguished by the fact that said wheel is provided on that face which is directed towards the core with a surface for bearing and centering on the insulating tube, an axial abutment for the insulating tube, and means for coupling in rotation with said insulating tube.

Thus, even when no end-piece is provided, the toothed wheel performs the combined functions of axial positioning, radial positioning and driving of the insulating tube in rotation.

Other features of the invention will be more apparent upon consideration of the following description and accompanying drawings, wherein.

FIGS. 11*a* and 11*b* are bottom views of the two spacer members assigned to the upper end of any one of the three cores;

FIGS. 12*a* and 12*b* are sectional views taken along the plane XII—XII of FIGS. 11*a* and 11*b;*

Figure 15:
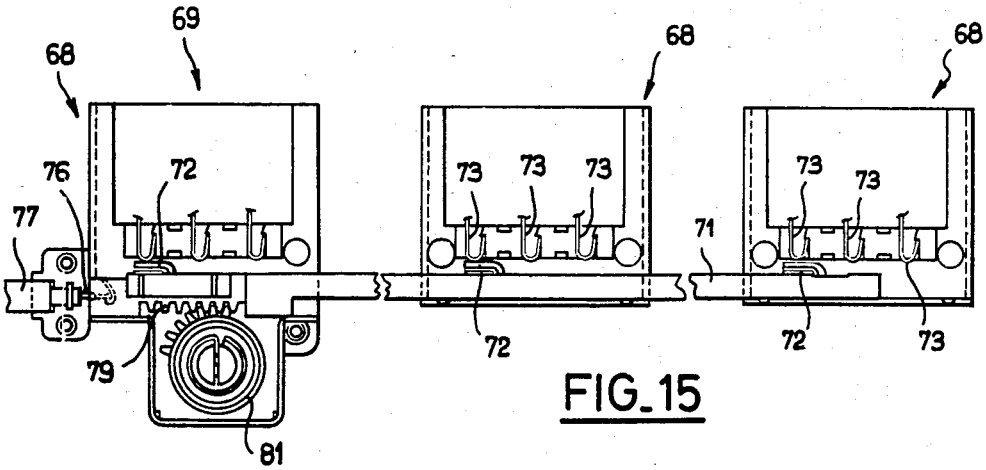
Figure 16:
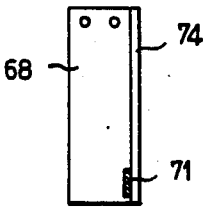
Figure 17:
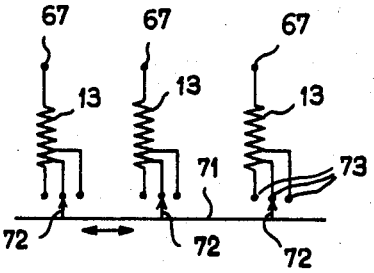

FIGS. 13 and 14 are views taken in the direction of the arrows XIII and XIV of FIGS. 11*a* and 11*b* respectively;

FIG. 15 is a fragmentary side elevational view of the transformer switching device, the covers of the casings having been removed;

FIG. 16 is an end view of one of the casings of FIG. 15, this view being taken in transverse cross-section through the actuating bar;

FIG. 17 is a schematic circuit diagram of the switching device.

In the example shown in the figures, the three-phase transformer is of the flat magnetic frame type; the frame 1 comprises three vertical rectilinear cores 2, the lower and upper ends of which are connected respectively by means of a top magnetic yoke 3 and a bottom magnetic yoke 4. This structure defines two rectangular magnetic windows 6 between the three cores 2.

The magnetic frame is fabricated in known manner from rolled strips of magnetic sheet iron. Said frame comprises a ring 7 which is rolled around each window 6 and a peripheral ring 8 surrounding both rings 7. Since each ring 7 or 8 has a semi-octagonal cross-section, each ring 7 and each yoke 3 or 4 has the same octagonal cross-section.

Figure 4:
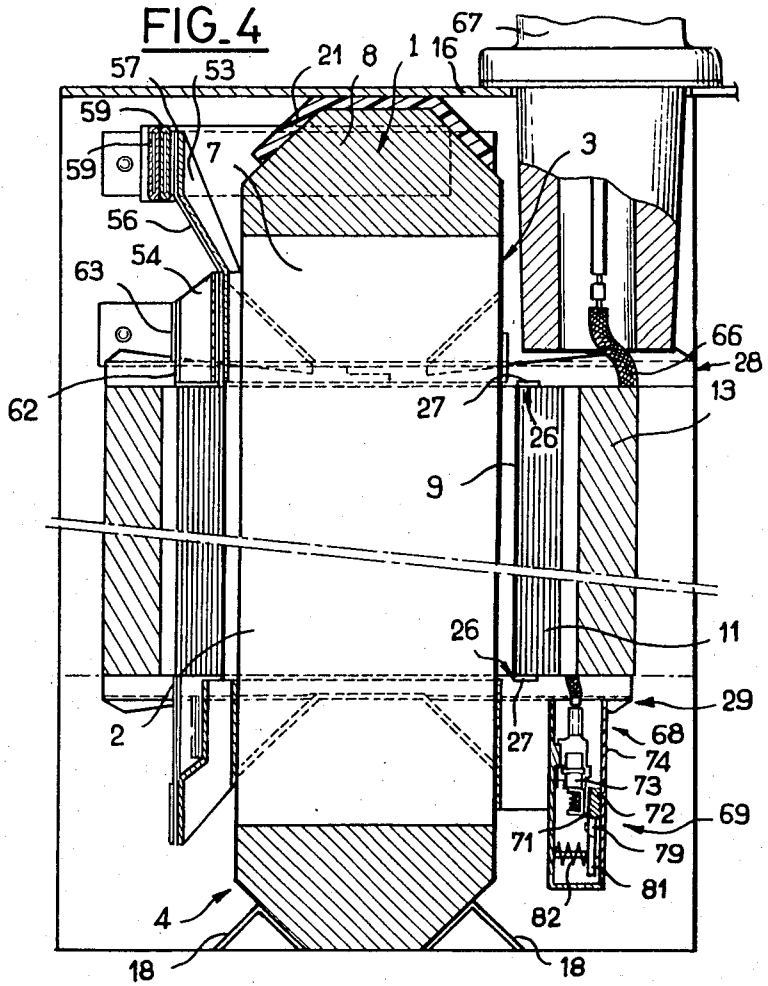
FIG. 4 is an enlarged transverse sectional view of the transformer, this view being taken along the plane IV—IV of FIG. 1.
Figure 3:
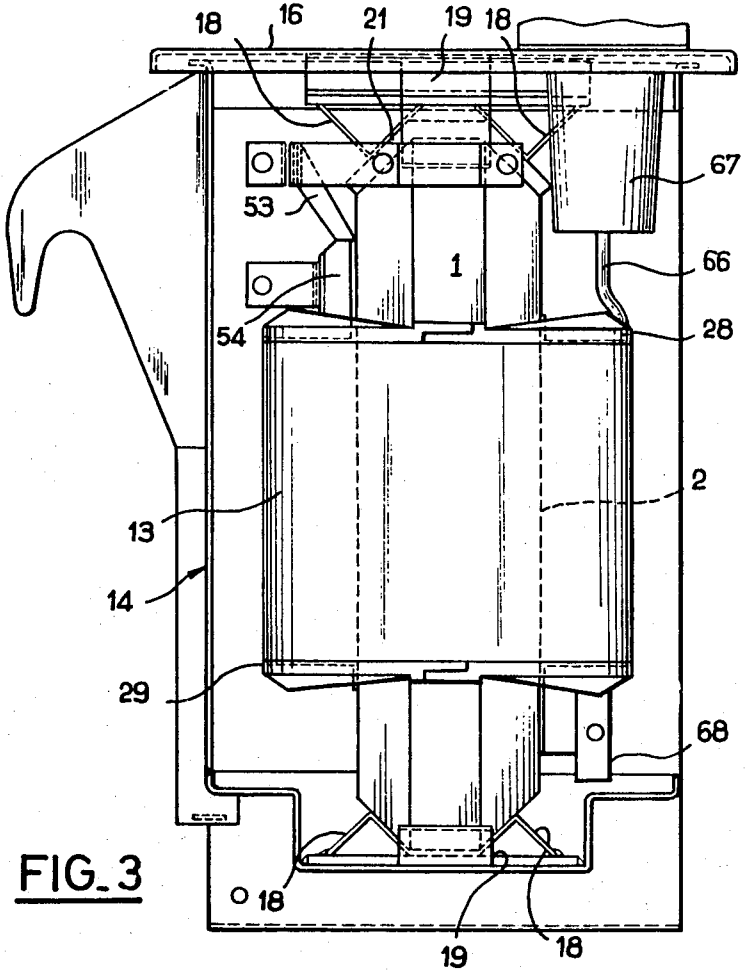
FIG. 3 is an end view of the active portion of the transformer of FIGS. 1 and 2, the transformer tank being shown in cross-section along a plane parallel to that of the figure.

As shown in FIG. 4, an insulating tube 9 is placed coaxially around each core 2, a small gap being left between tube and core. Taking the electric coupling of the transformer into account, each insulating tube 9 is adapted to carry a low-voltage winding 11 formed of aluminum strip and a high-voltage winding 13 formed of copper wire, said windings being coaxial with the tube 9 and the core 2. The two windings 11 and 13 extend over practically the entire length of the core 2, the high-voltage winding 13 being outermost. An insulating annular spacer member of known type (not shown in the drawings) is placed between the windings 11 and 13 and permits circulation of insulating oil between the windings in the axial direction.

The active portion of the transformer, that is, the unit consisting of the magnetic frame 1 and the electric windings 11, 13, is installed within a tank 14 containing insulating oil and closed by a top cover 16. Within said tank, the cores 2 are in a vertical position. The bottom wall 17 of the transformer tank is adapted to carry four longitudinal battens 18 and two transverse battens 19 having the combined function of receiving the magnetic frame 1 and of positioning this latter both in the longitudinal direction and in the transverse direction. The same arrangement is adopted beneath the cover 16: in this location, rubber blocks 21 are provided in addition between each pair of battens 18 and the frame 1 in order to ensure elastic positioning of this latter in the vertical direction.

Figure 5:
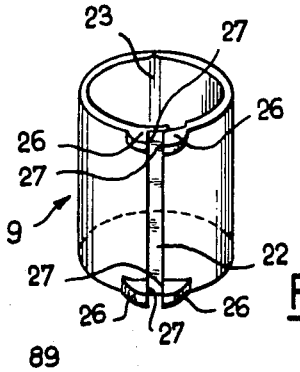
FIG. 5 is a perspective view of the insulating tube which is intended to surround one of the cores.
Figure 6:
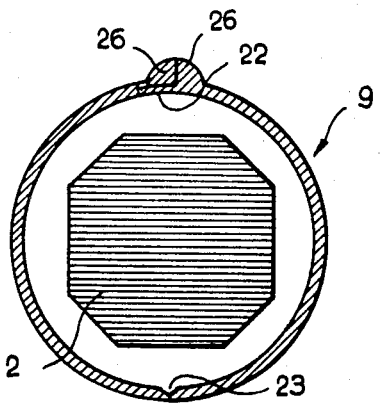
FIG. 6 is a transverse sectional view of one of the cores with its insulating tube.

As shown diagrammatically in FIG. 5, the insulating tube 9 is made of plastic material and is split so as to form a slit 22 along one of its generator-lines. As shown in FIGS. 5 and 6, the slit 22 has a sinuous profile or, more precisely, a stair-step profile, in order to achieve sufficient lengthening of the electric leakage path constituted by the slit and in order to prevent any possibility of sparkover between the electric windings and the magnetic core 2.

Along that generator-line 23 which is diametrically opposite to the slit 22, the insulating tube 9 has a thinner portion which forms a hinge.

At each annular extremity, the insulating tube is provided with two lugs 26 which are arranged on each side of the slit 22, adjacent said slit. On the side nearest the slit 22, each lug 26 has a face 27 located in a plane which passes through the axis of the slit 22, with the result that, when the slit 22 is closed, the two lugs 26 of one annular extremity are juxtaposed. Looking from above, the two lugs combined accordingly have a substantially semicircular shape. As shown in FIG. 4, each annular extremity of the insulating tube 9 projects in the axial direction beyond the windings 11 and 13 over a distance equal to the thickness of the lugs 26. Under service conditions, said lugs 26 are placed laterally against the inner winding 11. The face 27 of the lugs 26 is located in a plane at right angles to the plane of the magnetic frame 1.

Figure 8:
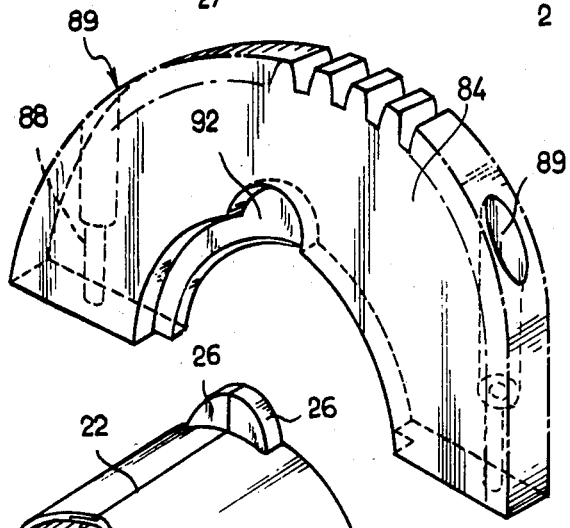
FIG. 8 is a schematic fragmentary bottom view of a spacer member for securing the windings.
Figure 8:
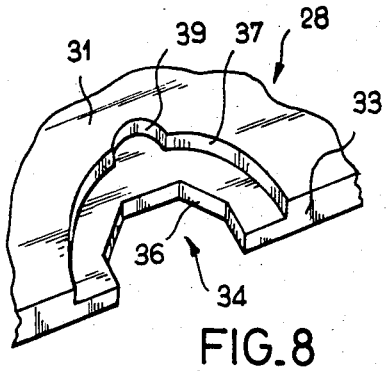
Figure 9:
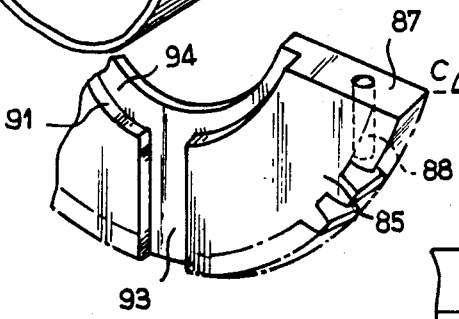
FIG. 9 is a fragmentary view in cross-section across the end of one of the cores and showing the tube surrounding the core as well as the two half-spacers assigned to said tube end, one of the half-spacers being shown in the mounted state and the other half-spacer being shown during the mounting operation.
Figure 9:
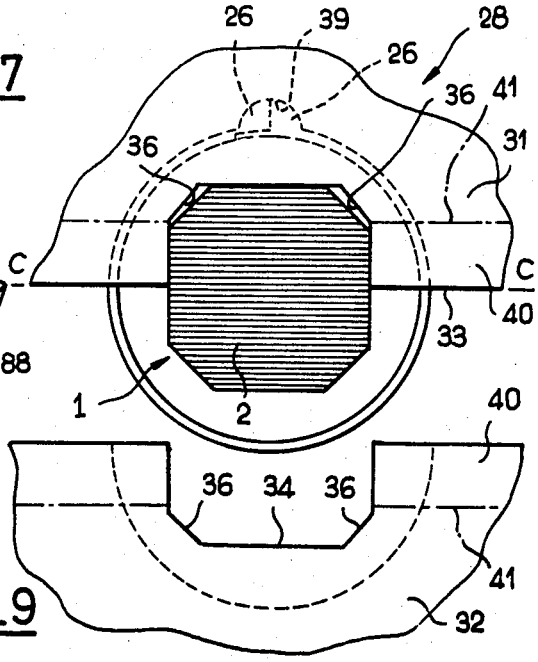

Each annular extremity of the insulating tube 9 is associated with an annular spacer member 28 or 29 (shown in FIG. 4) which is interposed between the annular extremity of the electric circuits 11, 13 and the adjacent magnetic yoke 3 or 4. The spacer member 28 considered by way of example is illustrated in a highly simplified manner in FIGS. 8 and 9. The spacer member 28 comprises two half-spacers 31, 32 having a generally semicircular shape. In the example illustrated, the joint plane 33 between the half-spacers 31 and 32 is located in the longitudinal mid-plane C—C of the magnetic frame 1 (as shown in FIG. 9).

On that annular face which is directed towards the core 2, the spacer member has a bearing surface 34, the contour of which corresponds to the profile of the core 2, with the result that, when the half-spacers 31, 32 are assembled around said core, the spacer member 28 does not have any freedom of radial movement or rotational movement with respect to the magnetic frame 1.

In the example shown, the surface 34 is octagonal as in the case of the core 2. However, the oblique faces 36 of the surface 34 are set back in order to prevent any contact with the core 2, which simplifies centering problems. Only those faces of the surface 34 which are parallel or perpendicular to the plane C—C are in contact with the core 2 and have a positioning function. Under service conditions, the surface 34 is located between the annular extremity of the insulating tube 9 and the adjacent yoke 3 or 4.

On that face which is directed towards the core, the spacer member 28 also has a second bearing surface 37 which is closer to the windings 11 and 13 than the face 34 in the axial direction. The face 37 which is farther from the axis of the core 2 than the face 34 is joined to this latter by means of a shouldered portion 38. The face 37, which is cylindrical and has a diameter equal to the external diameter of the insulating tube 9, bears on the external face of this latter and more precisely on that portion of the tube 9 which projects beyond the windings 11 and 13. The width of the surface 37 is equal to the length of the insulating tube 9 which extends beyond the windings 11 and 13.

In the position in which it is displaced by 90° with respect to the joint plane 33, the half-spacer 31 is provided with a semicircular recess 39, the shape of which corresponds to that of the two assembled lugs 26.

In the zone located between the two lines 41 (shown in FIG. 9) which delimit a region in which the spacer member is interposed between the innermost strip of the yoke 3 or 4 and the windings 11 to 13, the thickness e of the spacer member 28 is equal to the distance between the windings 11 and 13 of the adjacent yoke 3 or 4 under service conditions.

The spacer members 28, 29 which are made of injected plastic material thus have the combined functions of axial positioning, centering and rotational keying of the windings 11 and 13 on the core 2.

One practical form of construction of the spacer member 28 shown in FIGS. 11*a* to 14 will now be described in greater detail.

As shown in particular in FIGS. 13 and 14, each half-spacer 31 or 32 comprises a web 43 which is substantially flat in the zone 40 of application against the magnetic yoke 3 or 4. On that face which is directed towards the windings 11, 13, the web 43 is adapted to carry fins 44 which are located on each side of the central opening of the spacer member and are oriented at right angles to the plane C—C. On the same face, the web 43 is also adapted to carry fins 46 which are parallel to the fins 44 and extend outwards from the central opening of the spacer member 28.

The central opening of the spacer member 28 is delimited by an octagonal cut-out opening of the web 43, the edge of which constitutes the bearing surface 34 which is applied against the magnetic core 2.

As shown in particular in FIGS. 11*a*, 11*b*, 13 and 14, the surface 37 on which the spacer member 28 is applied against the insulating tube 9 is formed at that end of the fins 46 which is directed towards the central opening of the spacer member 28. To this end, each fin extremity forms a stair-step constituted by a portion of the face 36, a portion of the shoulder 38 and a portion of the surface 37.

On the half-spacer 31 alone, the surface 37 further comprises a cylindrical sector and a recess 39 formed in the central portion of said sector.

In the zone 40 of the spacer member 28, the web 43 is adapted to carry fins 48 on the web face which is directed towards the adjacent yoke 3 or 4, said fins being oriented obliquely with respect to the plane C—C. Again with respect to this plane C—C, the orientation of the fins 48 carried by one of the half-spacers 31, 32 on one side of the opening of the spacer member 28 is symmetrical with the orientation of the fins carried by the other half-spacer 31 or 32 on the same side of the central opening of the spacer member 28 and is identical with the orientation of the fins 48 carried by the other half-spacer 31 or 32 on the other side of the central opening of the spacer member 28.

Furthermore, as shown in FIGS. 13 and 14, the fins 48 are inclined in the direction of withdrawal of the half-spacers. Should there be a tendency towards withdrawal of the half-spacers, said fins consequently oppose any such withdrawal by being abuttingly applied against the adjacent magnetic yoke 3 or 4.

Outside the zone 40, the web 43 is convex (as shown in FIGS. 12*a* to 14) in the direction opposite to the windings 11, 13.

As shown in FIGS. 12*a* and 12*b*, the two half-spacers 31 and 32 are assembled along a stair-step joint plane, thereby achieving enhanced strength and precision of the assembly. The fins 44 carried by each half-spacer 31 or 32 are each in alignment with one of the fins 44 carried by the other half-spacer. The fin 44 located nearest the central opening of the spacer member 28 and designated as the fin 44*a* is of greater thickness than the others. A bore which is threaded in the case of the half-spacer 32 extends through said fin 44*a* and serves to assemble together the two half-spacers 31, 32 by means of screws of superpolyamide.

Figure 2:
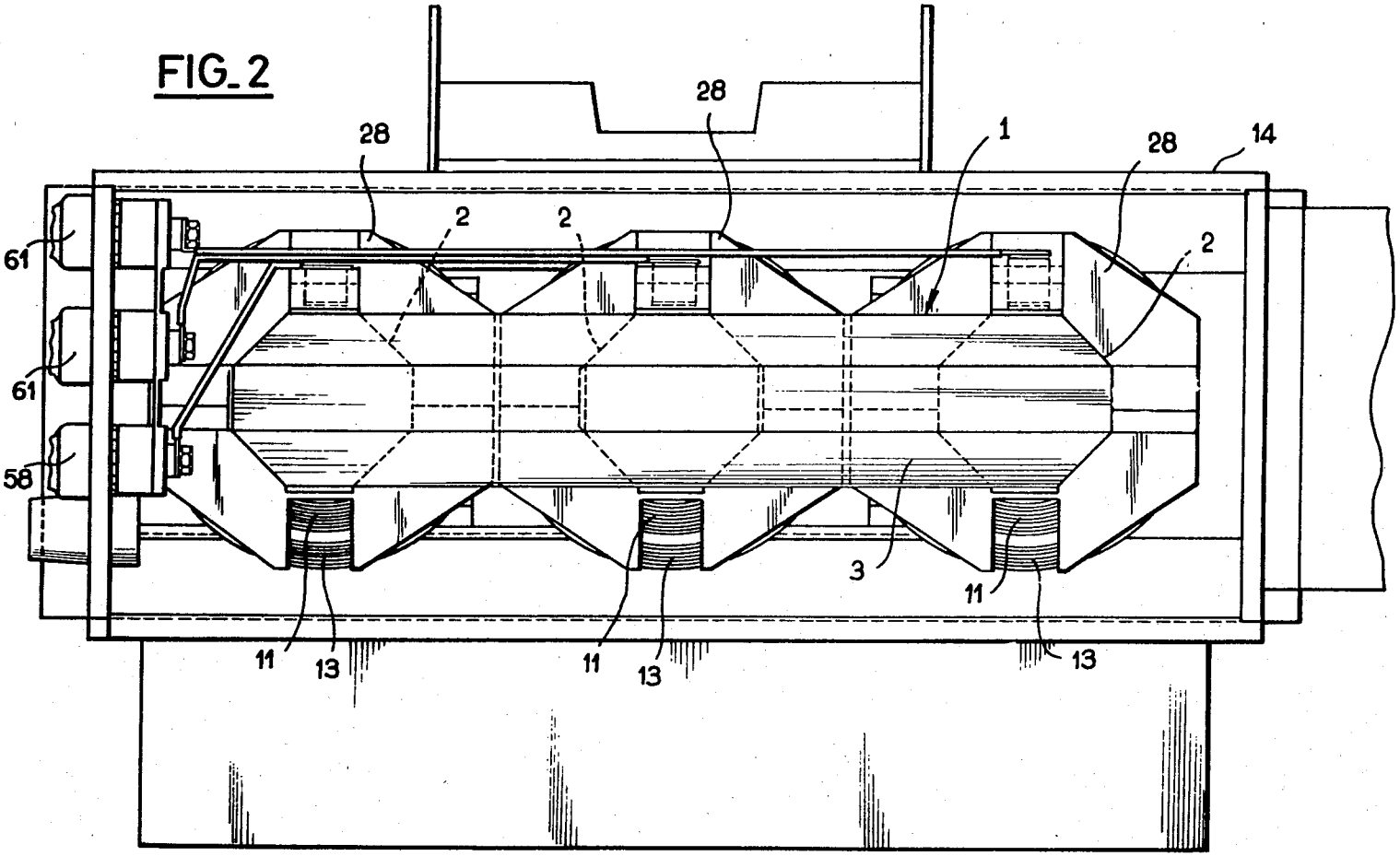
FIG. 2 is a top view of the transformer of FIG. 1, the tank cover having been removed.

Behind the two faces of the surface 34 which are parallel to the plane C—C, the half-spacers 31, 32 are provided with a rectangular slot 49 through which it is possible to view the lateral face of the windings 11 to 13 and through which the connections can be brought out. Each half-spacer 31 or 32 is adapted to carry on the side remote from the windings 11 to 13 a U-shaped fitting 51, the edge of which is attached to the web 43. The central portion of the fitting 51 is located between the central opening of the spacer member 28 and the slot 49 while the two arms of said fitting are directed away from the central opening. Each arm of the fitting 51 is provided with two catch-engagement holes 52 (as shown in FIG. 12*a*). Said fitting 51 of the half-spacer 32 serves to carry two supporting arms 53, 54 which are in turn intended to carry coupling members between the low-voltage windings of the transformer. As shown in FIG. 4, the supporting arm 53 is adapted to carry a blade 56 which is connected electrically to the inner end of the winding 11. The end of the supporting arm 53 is also adapted to carry a blade 57 which is connected electrically to the blade 56 and in turn connects this latter to a low-voltage phase terminal 58 mounted on one of the end walls of the transformer tank 14 (as shown in FIG. 2). Two other blades 59 surrounded by insulating material (FIG. 4) are mounted against the blade 57 and each serve to connect the winding 11 assigned to one of the other two cores 2 to one respective phase terminal which is placed next to the terminal 58 (as shown in FIG. 2).

Figure 1:
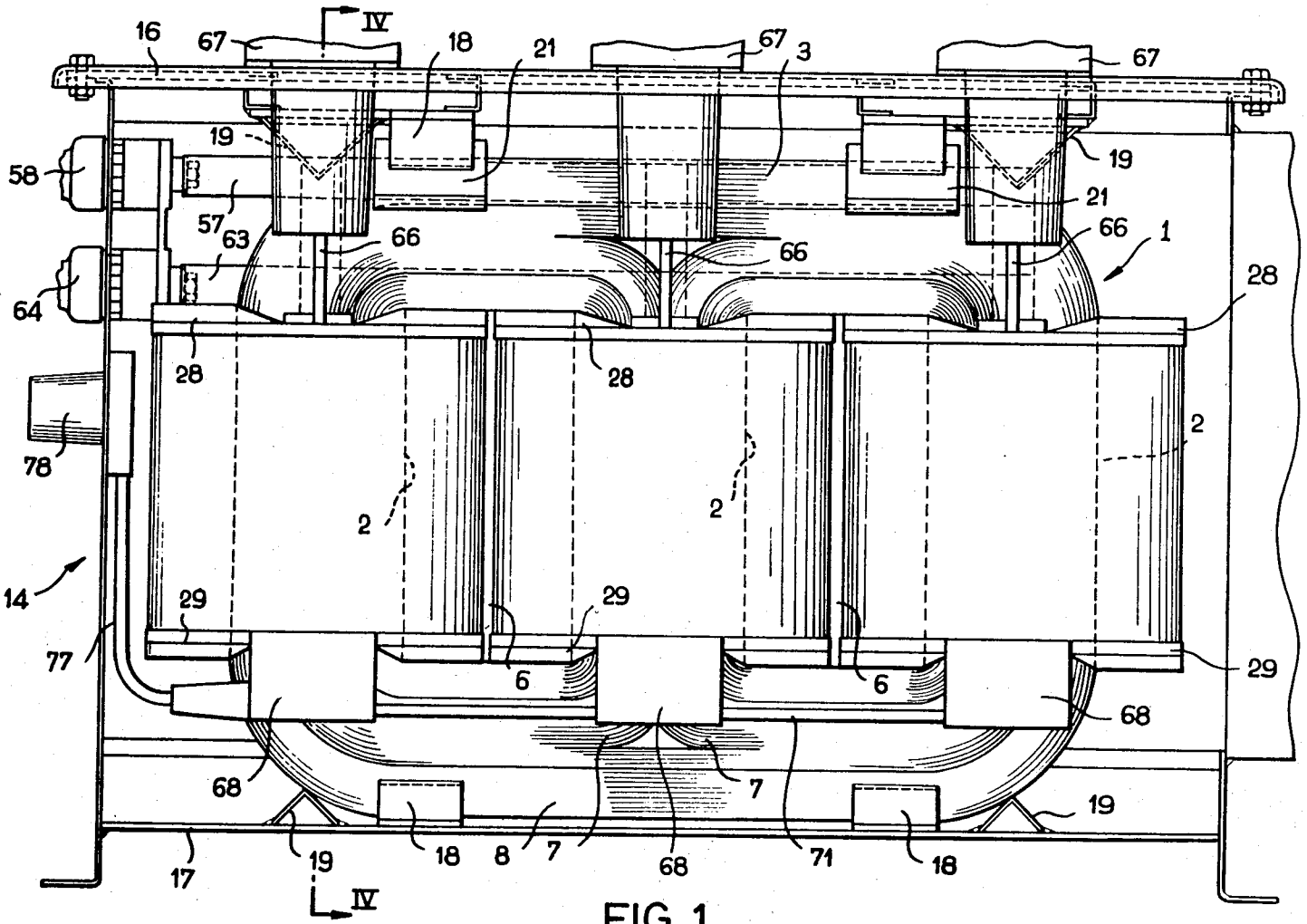
FIG. 1 is a side elevational view of a three-phase transformer according to the invention, the transformer tank being shown in cross-section along a plane parallel to the plane of the magnetic circuit.

The support member 54 is adapted to carry a blade 62 connected to the other end of the winding 11 and a longitudinal blade 63 for electrically coupling the blades 62 of the three transformer windings 11. The blade 63 is connected electrically to a neutral terminal 64 mounted at the end of the transformer beneath the terminals 58 and 61 (as shown in FIG. 1).

The fitting 51 of the half-spacer 31 does not carry any accessory. One of the end wires 66 of the high-voltage winding 13 is passed through the slot 49 of said half-spacer 31. Each wire 66 is connected directly to a high-voltage phase terminal 67 (shown in FIG. 4) which is mounted within the cover 16 of the transformer tank 14 immediately above the corresponding slot 49.

At the end of the windings 11 and 13 which are directed towards the bottom wall of the transformer tank 14, the spacer member 29 is adapted to carry a casing 68 which forms part of a switching device 69 for adjusting the transformation ratio of the transformer.

The switching device 69 is illustrated schematically in FIG. 17. This figure shows the three windings 13 which are star-connected between each terminal 67 and a conducting rack-bar 71 which is adapted to carry a contact 72 opposite to each winding 13. On the side facing said bar, each winding 13 is adapted to carry three output contacts 73: one contact is connected to the end of the winding 13, the second contact is connected to a turn located at a short distance from the end of the winding and the third contact is connected to a turn located at an even greater distance from the end of said winding. A displacement of the rack-bar 71 in its longitudinal direction corresponding to that of the transformer makes it possible to adjust the number of turns in service in each winding and consequently the transformation ratio of the transformer.

As shown in FIG. 15, the contacts 73 for each winding 13 are arranged within a casing 68. The conducting rack-bar 71 is slidably mounted between each casing 68 and a cover 74 which closes said casing as shown in FIG. 16. When in service, the rack-bar is located between the windings 11, 13 and the bottom of the transformer tank next to the magnetic yoke 4.

The rack-bar 71 is connected at one end to a cable 76 mounted within a sheath 77 and connected to a rotary control knob 78 placed beneath the terminal 64 (as shown in FIG. 1).

At the same end, the rack-bar 71 is adapted to carry a toothed rack 79 which is directed towards the bottom of the transformer tank 14. Said toothed rack is adapted to cooperate with a toothed wheel 81 to which is attached the end of a helical spring 82 (as shown in FIG. 4), the other end of said spring being attached to the casing 68. The spring 82 continuously urges the pinion 81 in the direction which corresponds to tensioning of the cable 76. The rack-bar is locked in the desired position-setting by means of a suitable device of known type which is provided within the control knob 78 (shown in FIG. 1).

The method of construction of the transformer in accordance with the design features indicated in the foregoing will now be described.

Strips of magnetic sheet-iron are first rolled so as to form the two inner rings 7 and then the outer ring 8 so as to complete the magnetic frame 1.

An insulating tube 9 is then placed around one of the magnetic cores 2 by opening-out the slit 22, by passing the magnetic core 2 through the slit 22 and then re-closing the slit 22 when the core 2 is in position within the tube 9. The hinge 23 permits relative pivotal displacement of the two semi-cylindrical half-shells constituting the insulating tube 9 during these operations.

Figure 7:
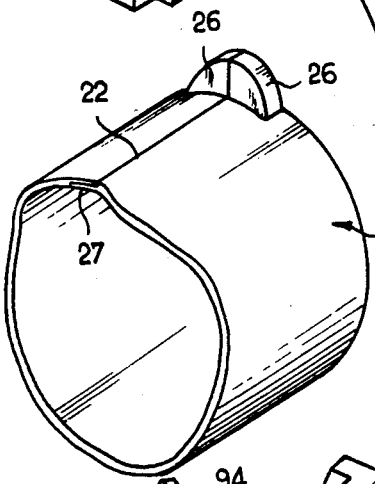
FIG. 7 is an exploded fragmentary view in perspective showing the insulating tube and a driving wheel for its winding.

There is then placed in position at each end of the insulating tube 9 a toothed driving wheel 83 (shown in FIGS. 7 and 10) formed by two half-wheels separated by a joint plane which passes substantially through the axis of the wheel 83. The two half-wheels are intended to be joined together by screwing in position around the magnetic core 2 and around that end of the insulating tube 9 to which the wheel 83 is assigned. Accordingly, the wheel 83 is provided on each side of its central opening with two bores 88 which pass through the joint plane 87 between the half-wheels 84 and 85. The bores 88 are internally threaded in the half-wheel 85 (whose set of teeth is not illustrated) and terminate in a counterbore 89 which opens into the set of teeth (shown only to a partial extent) of the half-wheel 84.

On that annular face which is directed towards the magnetic core 2, the wheel 83 has a cylindrical surface 91 which is intended to be applied against the entire annular extremity of the insulating tube 9. The axial dimension of the surface 91 corresponds to the length of the insulating tube 9 which must project beyond the windings 11, 13. In a position located at 90° with respect to the joint plane 87, the half-wheel 84 is provided with a recess 92 which is intended to receive the juxtaposed lugs 26. On the side remote from the recess 92, the half-wheel 85 is provided with a radial groove 93 which extends from the surface 91 to the toothed periphery of the wheel 83.

On the side opposite to the windings, the surface 91 has an edge in the form of an annular flange 94 which serves as an abutment for the insulating tube 9.

Figure 10:
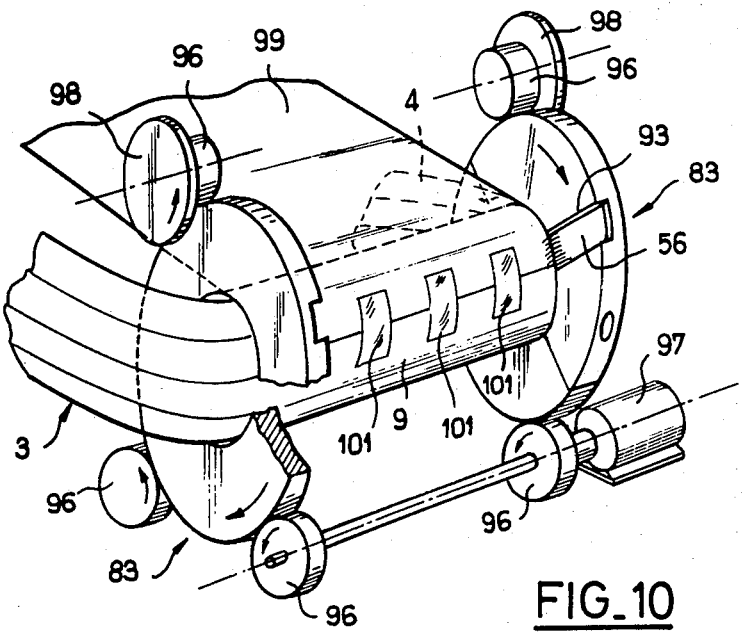
FIG. 10 is a perspective view of the operation which consists in winding the low-voltage circuit.

Once the two toothed wheels 83 are in position (as shown in FIG. 10), three toothed planet-wheels 96 are positioned around each wheel 83. In the case of each wheel 83, one of the planet-wheels 96 is coupled to a motor 97 while the other two wheels simply have the function of centering the wheels 83. One of said wheels is adapted to carry on the side remote from the insulating tube 9 an annular flange 98 having the intended function of positioning the wheels 83 in the axial direction.

The conducting band 99 is then brought into position. A transverse conducting strip has been attached to the end of said band 99 and constitutes on each side of this latter a blade 56 which is engaged within the groove 93 of the adjacent driving wheel 83. One of the blades 56 will subsequently constitute the phase contact blade of the winding (as shown in FIG. 4) while the other blade (not visible in FIG. 10) which can be much shorter serves only for displacing the band 99 by means of the wheels 83.

The band 99 is formed of aluminum strip covered with a sheet of insulating paper which is intended to provide electrical insulation of one turn during formation of the following turn.

In order to ensure that the band 99 can be readily displaced by the wheels 83, the starting edge of the band is held in position with adhesive tape 101.

When the low-voltage winding 11 has been completed, the coupling blade 63 (shown in FIG. 4) of the common voltage point is attached to the end of said winding and engaged within the groove 93 of the wheel 83 (as shown in FIG. 10).

An insulating spacer member of plastic material (not shown in the drawings) is then placed around the winding 11. Said spacer member is of a known type similar to a ladder bent into a circle so as to bring its two ends together.

The winding 13 is then formed around said spacer member in a manner which, in regard to the arrangement of the turns and the insulation of these latter with respect to each other, is similar to the method described in U.S. Pat. No. 2,968,445.

During formation of the winding 13, the contacts 73 are connected in their intended locations.

Once the winding 13 has been completed, the wheels 83 are removed and the windings are formed around the other two magnetic cores 2 in the same manner.

The annular spacer members 28 and 29 are then fitted in position around each core 2, the accessories 53, 54, 68 (shown in FIG. 4) are placed in position and the connections are made.

The transformer which has just been described is thus particularly easy to construct, is of low weight, of compact design, and provides efficient performance. The insulating tube 9 can in fact be fitted in position with great ease and also calls for only a very small space between the winding 11 and the magnetic core 2. Furthermore, by virtue of this method of formation of windings by means of the insulating tube 9, practically the entire length of the cores 2 is occupied by the windings.

The annular spacer members 28 and 29 cooperate with the insulating tube 9 in a ingenious manner and alone perform all the functions of positioning of the windings with respect to the magnetic frame 1. The highly accurate positioning thus ensured makes it possible to reduce the safety margins required for insulation gaps, which is advantageous from the point of view of both lightness of weight and performance.

By virtue of the fins 44 and 46 and also by providing the web 43 with convex portions which perform the function of oil deflectors, a circulation of oil can in fact take place between the windings as a result of a thermosiphon effect.

As can readily be understood, the invention is not limited to the example illustrated in the drawings and many alternative arrangements may accordingly be made in this example without thereby departing from the scope of the invention.

From this it follows that the invention is applicable to any monophase or polyphase transformer having one or a number of rectangular windows.

It is not essential to ensure that the insulating tube carries means for coupling in rotation with the driving wheels and the spacer members. By way of example, coupling could be effected by means of a thin projection carried by the wheels and the spacer members and adapted to engage within the slit 22.

The insulating tube can be constituted by two completely separate shells or else it can be constituted on the contrary by a single elastic shell without any hinge.

Furthermore, only a single driving wheel need be provided.

Arrangements could also be made to wind the high-voltage circuit directly around the insulating tube while the low-voltage circuit is wound around the high-voltage circuit.

What is claimed is:

1. A method of constructing a transformer, comprising the steps of:

forming a magnetic frame with at least one core and at least one yoke which define together at least one substantially rectangular window;

disposing an insulating tube around the magnetic core;

placing a driving wheel around the core and detachably coupling said wheel to at least one end of said tube;

winding electrical turns around the insulating tube by causing a movement of rotation of the wheel, while keeping end portions of the tube free from electrical turns;

removing the driving wheel from the tube;

interposing axially between the yoke and each end of an electric winding comprising the wound electric turns an annular spacer while centering a respective one of said end portions of the tube in a first aperture surface of the annular spacer, centering a second aperture surface of the annular spacer around the magnetic core, and abutting an annular end of the tube against an annular shoulder provided on the spacer between the two aperture surfaces.

2. A method according to claim 1, wherein the step of interposing an annular spacer comprises the step of joining together two half annular spacers.

* * * * *